US009822661B2

(12) United States Patent
Jorde

(10) Patent No.: US 9,822,661 B2
(45) Date of Patent: Nov. 21, 2017

(54) METHOD AND APPARATUS TO PROTECT DOWNSTREAM ENGINE COMPONENTS FROM DAMAGE IN THE EVENT OF A TURBINE FAILURE

(71) Applicant: Dean Jorde, Victoria (CA)

(72) Inventor: Dean Jorde, Victoria (CA)

( * ) Notice: Subject to any disclaimer, the term of this patent is extended or adjusted under 35 U.S.C. 154(b) by 633 days.

(21) Appl. No.: 14/332,869

(22) Filed: Jul. 16, 2014

(65) Prior Publication Data

US 2015/0030436 A1 Jan. 29, 2015

(30) Foreign Application Priority Data

Jul. 23, 2013 (CA) ..... 2821748

(51) Int. Cl.
*F01D 21/04* (2006.01)
*F02B 39/16* (2006.01)
*F01D 25/30* (2006.01)

(52) U.S. Cl.
CPC ..... *F01D 21/045* (2013.01); *F02B 39/16* (2013.01); *F01D 25/30* (2013.01); *F01N 2240/20* (2013.01); *F01N 2260/26* (2013.01); *F05D 2220/40* (2013.01); *Y10T 29/49718* (2015.01)

(58) Field of Classification Search
CPC ..... F01D 21/045; F01D 21/00; B01D 39/10; B01D 39/12; B01D 39/2027; B01D 45/00; B01D 45/04; B01D 46/24; B01D 46/2403; B01D 46/00; B01D 46/0001; F05D 2260/40; F05D 2260/607
USPC ..... 415/9, 121.2
See application file for complete search history.

(56) References Cited

U.S. PATENT DOCUMENTS 4,077,739 A * 3/1978 Heilenbach ..... F02C 6/12 415/121.2
8,763,382 B2 * 7/2014 Champoux ..... F01N 3/0215 55/445

* cited by examiner

*Primary Examiner* — Woody Lee, Jr.
*Assistant Examiner* — Sabbir Hasan
(74) *Attorney, Agent, or Firm* — Davis & Bujold PLLC; Michael J. Bujold

(57) ABSTRACT

A method and apparatus for protecting downstream engine components from damage in the event of a turbine failure involves positioning a debris trap downstream of a turbo and upstream of an engine. The debris trap includes an outer body with an inlet opening at a first end of a first diameter, an outlet opening, and an interior of a second diameter which is larger than the inlet opening. An inner body extends into the interior of the outer body with air flow openings in the inner body communicating with the outlet opening. An impaction plate is supported by the inner body in axial alignment with the inlet opening. Turbo fragments strike and are slowed by impact with the impaction plate. The turbo fragments collect in the interior of the outer body with air escaping by entering the air flow openings of the inner body and passing to the outlet opening.

7 Claims, 4 Drawing Sheets

METHOD AND APPARATUS TO PROTECT DOWNSTREAM ENGINE COMPONENTS FROM DAMAGE IN THE EVENT OF A TURBINE FAILURE

FIELD

There is described a method and associated apparatus to protect downstream engine components from damage in the event of turbine failure on a compressor side of a turbocharger.

BACKGROUND

A turbine (often referred to as a "turbo") is located on a compressor side of a turbocharger for an engine. This turbine will eventually fail. However, unlike other machine components, when the turbo fails it tends to disintegrate; sending turbo fragments downstream at high velocity. There is needed a method and an apparatus that will prevent damage to downstream engine components in the event of turbo failure.

SUMMARY

According to one aspect there is provided a method of protecting downstream engine components from damage in the event of a turbine (turbo) failure by positioning a debris trap downstream of a turbo and upstream of an engine component. The debris trap includes an outer body, an inner body and an impaction plate. The outer body has an inlet opening at a first end of a first diameter, an outlet opening, and an interior of a second diameter which is larger than the inlet opening. The inner body extends into the interior of the outer body with air flow openings in the inner body communicating with the outlet opening. The impaction plate is supported by the inner body. The impaction plate is in axial alignment with the inlet opening. Upon failure of the turbo, turbo fragments strike and are slowed by impact with the impaction plate. The turbo fragments collect in the interior of the outer body with air escaping by entering the air flow openings of the inner body and passing to the outlet opening.

According to another aspect there is provided an apparatus to protect downstream engine components from damage in the event of a turbo failure. The best mode of this apparatus has as main components an outer body, an inner body and an impaction plate. The outer body has a first end, a second end and a peripheral sidewall defining an interior. An inlet opening is positioned at the first end of a first diameter and an outlet opening at the second end. The interior is of a second diameter which is larger than the inlet opening. The inner body is hollow and has a first end, a second end and a peripheral sidewall that defines an interior air flow passage. The second end of the inner body communicates with the outlet opening of the outer body. The first end of the inner body extends into the interior of the outer body in axial alignment with the inlet opening to define a debris collection annulus. Air flow openings in the peripheral sidewall of the inner body communicate with the interior air flow passage. The impaction plate is positioned at the first end of the inner body. In normal use, a high velocity stream of air passes into the inlet opening, through the air flow openings in the peripheral sidewall to the interior air flow passage and then out the outlet opening. In the event of turbo failure, turbo fragments strike and are slowed by impact with the impaction plate, with the turbo fragments collecting in the debris collection annulus while the high velocity stream of air escapes the debris collection annulus by entering the air flow openings in the peripheral sidewall of the inner body and passing along the interior air flow passage to the outlet opening.

The theory behind the above described apparatus is that the positioning of the inner body relative to the outer body forces flowing air to change direction, while any solid debris impacts upon the impaction plate and gets trapped in the debris collection annulus.

Although beneficial results may be obtained through the use of what has been described above, it has been determined that improved results may be obtained when the impaction plate has an outer edge that slopes outwardly toward the second end of the inner body. This profile helps smooth the flowing air and reduces turbulence as the air passes around the first end of the inner body. This lowers the overall aerodynamic drag and pressure drop in the apparatus.

Small particles, that is particles smaller than 3 mm, have a tendency to be carried by the flowing air. Improved results may be obtained if at least one layer of mesh overlies the air flow openings of the inner body to prevent these smaller debris particles from passing to the interior air flow passage.

In computer modelling it was determined that having two or more layers of sidewall was better than a single sidewall. It is, therefore, preferred that the inner body has more than one peripheral sidewall, each peripheral sidewall having a progressively smaller diameter.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
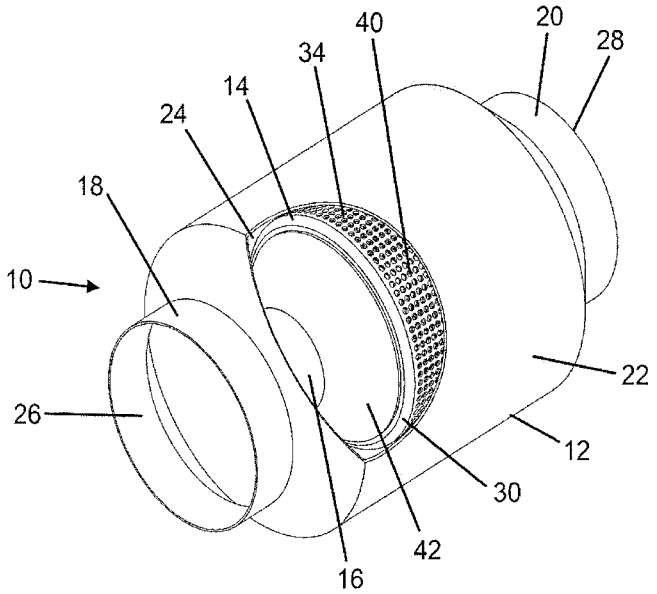
FIG. 1 is a perspective view of an apparatus.

An apparatus to protect downstream engine components from damage in the event of turbo failure generally identified by reference numeral 10, will now be described with reference to FIG. 1 through FIG. 4.

Figure 2:
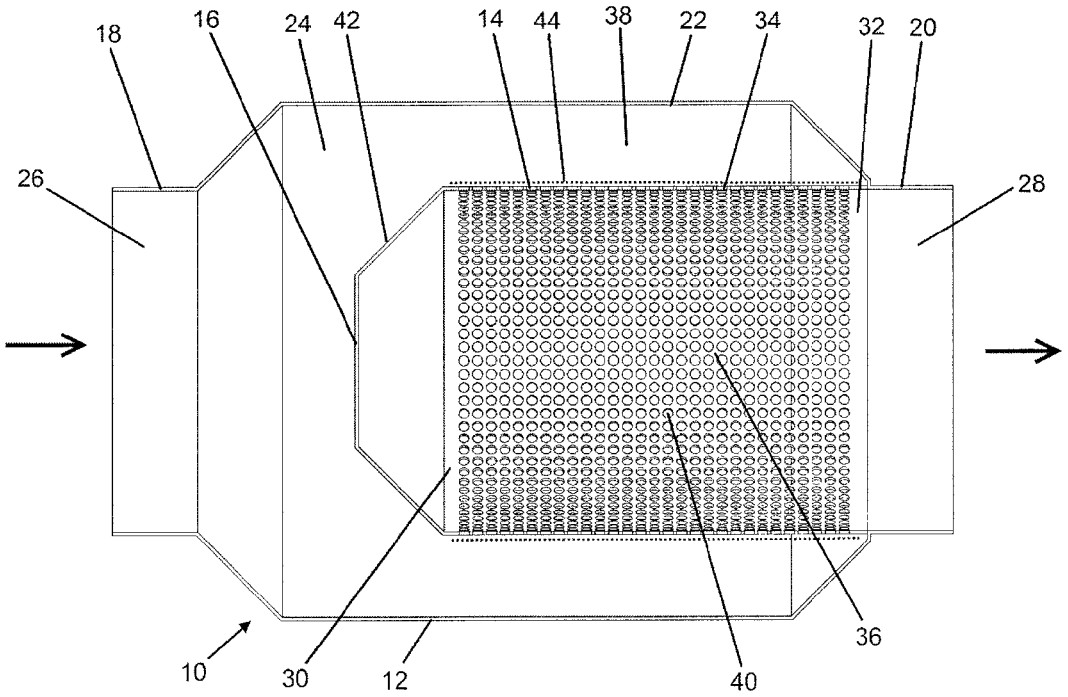
FIG. 2 is a side elevation view, in section, of the apparatus illustrated in FIG. 1.

Structure and Relationship of Parts:

Referring to FIG. 1 and FIG. 2, apparatus 10 has as main components an outer body 12, an inner body 14 and an impaction plate 16. Outer body 12 has a first end 18, a second end 20 and a peripheral sidewall 22 which serve to define an interior 24. An inlet opening 26 is positioned at first end 18 and an outlet opening 28 is positioned at the second end 20. Inlet opening 26 is of a first diameter and interior 24 of outer body 12 is of a second diameter which is larger than inlet opening 26.

Inner body 14 is hollow and has a first end 30, a second end 32 and a peripheral sidewall 34 that defines an interior air flow passage 36 that runs the length of inner body 14. Second end 32 of inner body 14 communicates with outlet opening 28 of outer body 12. First end 30 of inner body 14 extends into interior 24 of outer body 12 in axial alignment with inlet opening 26 to define a debris collection annulus 38. Air flow openings 40 are positioned in peripheral sidewall 34 of inner body 14 and communicate with interior air flow passage 36.

Impaction plate 16 is positioned at first end 30 of inner body 14. In normal use, a high velocity stream of air passes into inlet opening 26, is diverted by impaction plate 16 around first end 30 of inner body 14. The air then passes through air flow openings 40 in peripheral sidewall 34 of inner body 14 to interior air flow passage 36 and then out of outlet opening 28. In the event of turbo failure, turbo fragments are fired from the disintegrating turbo like bullets from a gun far in excess of the speed of the high velocity stream of air. These turbo fragments strike and are slowed by impact with impaction plate 16. The turbo fragments then collect in debris collection annulus 38, while the high velocity stream of air escapes debris collection annulus 38 by entering air flow openings 40 in peripheral sidewall 34 of inner body 14 and passing along interior air flow passage 36 to outlet opening 28. It is preferred that impaction plate 16 has an outer edge 42 that slopes outwardly toward second end 32 of inner body 14. This nose cone profile helps smooth the flowing air and reduces turbulence as the air passes around first end 30 of the inner body 14. This lowers the overall aerodynamic drag and pressure drop in apparatus 10.

Referring to FIG. 2, small particles, that is particles smaller than 3 mm, have a tendency to be carried out of debris collection annulus 38 by the flowing air. It is, therefore, preferred that at least one layer of mesh 44 be placed so that it overlies air flow openings 40 of inner body 14 to prevent these smaller debris particles from passing to interior air flow passage 36 and being carried downstream.

Figure 3:
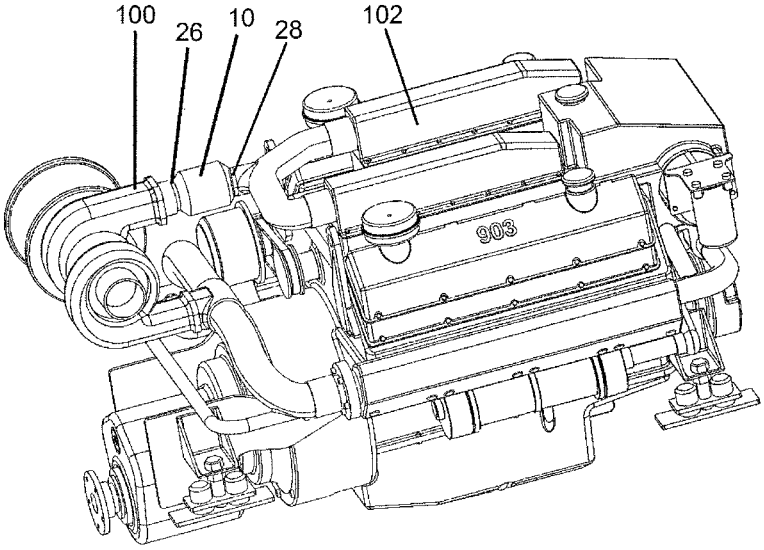
FIG. 3 is a side elevation of the apparatus illustrated in FIG. 1 installed in accordance with the teaching of the method.

Operation:

Referring to FIG. 3, there is illustrated a turbo 100, an engine 102 with apparatus 10 serving as a debris trap positioned downstream of turbo 100 and upstream of engine 102. It is preferred that there be a linear relationship between the outlet of turbo 100 and inlet opening 26 of apparatus 10. The reason for this is that when the turbo fails and debris is propelled from the turbo, such debris will pass from outlet of turbo 100 like a bullet from a gun. Referring to FIG. 2, these turbo fragments strike and are slowed by impact with impaction plate 16. The turbo fragments then collect in debris collection annulus 38, while the high velocity stream of air escapes debris collection annulus 38 by entering air flow openings 40 in peripheral sidewall 34 of inner body 14 and passing along interior air flow passage 36 to outlet opening 28. As previously described, sloped outer edge 42 of impaction plate 16 serves to reduce turbulence as air passes around first end 30 of the inner body 14. Small particles, that is particles smaller than 3 mm, that would are carried out of debris collection annulus 38 by the flowing air are caught by mesh 44 which overlie air flow openings 40 of inner body 14.

Figure 4:
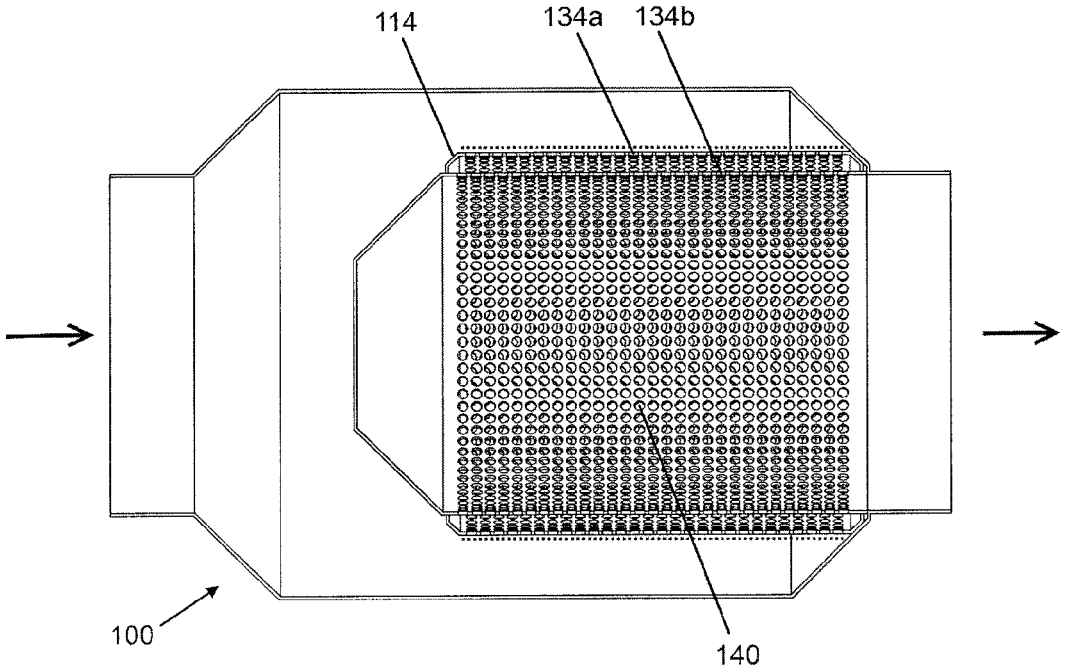
FIG. 4 is a side elevation, in section, of an alternative embodiment of the apparatus having multiple sidewalls of progressively smaller diameters.

Variations:

Referring to FIG. 4, large particles, that is particles larger than 3 mm, may have enough impact energy to deform the material of inner body 14 and enlarge some of flow openings 40 to the point where turbo debris flows through inner body 14 to interior air flow passage 36. To prevent this from happening, alternative embodiment 100 has an inner body 114 constructed with two or more layers of sidewall with flow openings 140, shown as 134*a* and 134*b*, each with progressively smaller diameters. In computer modelling it was determined that having two or more layers of sidewall was better than a single sidewall. Even though the pressure drop through two or more layers of sidewall is greater than a single sidewall, lower peak velocities result in a considerably lower overall pressure drop. The use of two or more layers of sidewall means that particles that punch through sidewall 134*a* are likely to be stopped by sidewall 134*b* and remain trapped between sidewall 134*a* and sidewall 134*b*.

In computer modelling, the air flow direction shown in FIG. 2 is the best air flow. However, when apparatus 10 was hooked up so that the air flow was reversed, apparatus 10 still worked, although not as well.

Cautionary Warnings:

A Holset HX50 Turbo for a 650-750 horse power engine has a turbo wheel that tapers to a tip that is 5 mm high. The mass flowrate is 0.6 kg/s with a pressure ratio of 3.0. For sea level operation this gives an approximate turbo outlet air pressure of 300 kPa. In the analysis scenario it was assumed that the tip had broken off and was propelled downstream. Based upon the turbine wheel tip dimensions, the broken tip was modelled as being 5 mm×5 mm×1 mm. The election velocity was calculated to be 500 m/s at a turbine wheel speed of 100,000 rpm. Based upon these parameters the broken tip would be travelling at 1.5 times the speed of sound in sea level standard air. At these speeds swirling air will have little or no effect on the trajectory of the broken tip, for the air is moving relatively slowly (30 to 50 m/s) in comparison to the speed of the debris from the turbine (200 to 500 m/s). At these speeds it is no wonder that debris from a failed turbo causes such damage to downstream engine components. When building an apparatus, such as the one described above, materials must be selected that are capable of withstanding the impacts of debris from the turbo.

While multiple layers of sidewall 34 proved to have a beneficial effect on performance, multiple layers of mesh 44 will not. Computer modelling indicates that too many layers of mesh 44 can unduly diminish air flow. It is likely best to limit the layers of mesh 44 to a single layer or two layers at the most.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The illustrated embodiments have been set forth only as examples and should not be taken as limiting a purposive interpretation of the claims.

What is claimed is:

1. An apparatus to protect downstream engine components from damage in an event of a turbo failure, comprising:

an outer body having an inlet opening at a first end of a first diameter, an outlet opening, and an interior of a second diameter which is larger than the inlet opening;

an inner body extending into the interior of the outer body, the inner body having a peripheral sidewall, opposed ends and air flow openings in the peripheral sidewall through which air must pass to reach the outlet opening of the outer body; and an air impervious solid impaction plate supported at one of the opposed ends of the inner body, the impaction plate being in axial alignment with the inlet opening, such that upon failure of the turbo, turbo fragments strike and are slowed by impact with the impaction plate, the turbo fragments collecting in the interior of one of the inner body or the outer body with air escaping by entering the air flow openings in the peripheral sidewall of the inner body and passing to the outlet opening of the outer body.

2. An apparatus to protect downstream engine components from damage in an event of a turbo failure, comprising:

an outer body having an inlet opening at a first end of a first diameter, an outlet opening, and an interior of a second diameter which is larger than the inlet opening;

an inner body extending into the interior of the outer body, the inner body having a peripheral sidewall that defines a circumferential debris collection annulus between the inner body and the outer body, with air flow openings in the peripheral sidewall of the inner body communicating with the outlet opening; and an air impervious solid impaction plate supported at one end of the inner body, the impaction plate being in axial alignment with the inlet opening and having an outer edge that slopes outwardly toward the second end of the inner body, such that upon failure of the turbo, turbo fragments strike and are slowed by impact with the impaction plate, the flowing air which carries turbo fragments being directed by the slope of the outer edge of the impaction plate into the debris collection annulus in the interior of the outer body with air escaping by entering the air flow openings in the peripheral sidewall of the inner body and passing to the outlet opening.

3. An apparatus to protect downstream engine components from damage in the event of a turbine failure, comprising:

an outer body having a first end, a second end and a peripheral sidewall, an inlet opening at the first end of a first diameter, an outlet opening at the second end; and an interior of a second diameter which is larger than the inlet opening;

a hollow inner body having a first end, a second end and a peripheral sidewall that defines an interior air flow passage, the second end of the inner body communicating with the outlet opening of the outer body and the first end of the inner body extending into the interior of the outer body in axial alignment with the inlet opening to define a debris collection annulus, air flow openings in the peripheral sidewall of the inner body communicating with the interior air flow passage; and an impaction plate at the first end of the inner body, such that upon failure of the turbo, turbo fragments strike and are slowed by impact with the impaction plate, the turbo fragments collecting in the debris collection annulus with air escaping the debris collection annulus by entering the air flow openings in the peripheral sidewall of the inner body and passing along the interior air flow passage to the outlet opening.

4. The apparatus of claim 3, wherein the impaction plate has an outer edge that slopes outwardly toward the second end of the inner body.

5. The apparatus of claim 3, wherein at least one layer of mesh overlies the air flow openings of the inner body to prevent debris particles from passing to the interior air flow passage.

6. The apparatus of claim 3, wherein the inner body has more than one peripheral sidewall, each peripheral sidewall having a progressively smaller diameter.

7. A method of protecting downstream engine components from damage in the event of a turbine failure, comprising:

positioning a debris trap downstream of a turbo and upstream of an engine component, the debris trap comprising:

an outer body having an inlet opening at a first end of a first diameter, an outlet opening, and an interior of a second diameter which is larger than the inlet opening;

an inner body extending into the interior of the outer body with air flow openings in the inner body communicating with the outlet opening; and an impaction plate supported by the inner body, the impaction plate being in axial alignment with the inlet opening, such that upon failure of the turbo, turbo fragments strike and are slowed by impact with the impaction plate, the turbo fragments collecting in the interior of the outer body with air escaping by entering the air flow openings of the inner body and passing to the outlet opening.

* * * * *